United States Patent [19]

Horiuchi et al.

[11] Patent Number: 4,710,318

[45] Date of Patent: Dec. 1, 1987

[54] METHOD OF PROCESSING RADIOACTIVE WASTE

[75] Inventors: Susumu Horiuchi; Shin Tamata, both of Hitachi, Japan

[73] Assignee: Hitachi, Ltd., Tokyo, Japan

[21] Appl. No.: 761,334

[22] Filed: Jul. 31, 1985

Related U.S. Application Data

[63] Continuation of Ser. No. 500,827, Jun. 3, 1983, abandoned.

[30] Foreign Application Priority Data

Jun. 4, 1982 [JP] Japan ..... 57-96585

[51] Int. Cl.[4] ..... G21F 9/16

[52] U.S. Cl. ..... 252/628; 252/632; 264/0.5

[58] Field of Search ..... 252/626, 628, 631, 632, 252/633; 264/0.5; 106/74, 76, 85, 89

[56] References Cited

U.S. PATENT DOCUMENTS

| | | | |
|---|---|---|---|
| 3,669,631 | 6/1972 | Dietrich et al. | 252/631 |
| 3,988,258 | 10/1976 | Curtiss et al. | 252/628 |
| 4,033,868 | 7/1977 | Meichsner et al. | 252/632 |
| 4,069,295 | 1/1978 | Sugahara et al. | 423/49 |
| 4,086,325 | 4/1978 | Cordier et al. | 252/628 |
| 4,122,028 | 10/1978 | Iffland et al. | 252/628 |
| 4,173,546 | 11/1979 | Hayes | 252/628 |
| 4,234,448 | 11/1980 | Hirano et al. | 252/632 |
| 4,268,409 | 5/1981 | Ga et al. | 252/632 |
| 4,290,907 | 9/1981 | Horiuchi et al. | 252/632 |
| 4,290,908 | 9/1981 | Horiuchi et al. | 252/632 |
| 4,299,721 | 11/1981 | Hirano et al. | 252/628 |
| 4,401,608 | 8/1983 | Smith | 264/0.5 |

FOREIGN PATENT DOCUMENTS

| | | | |
|---|---|---|---|
| 2851231 | 5/1979 | Fed. Rep. of Germany | 252/632 |
| 2929294 | 1/1980 | Fed. Rep. of Germany . | |
| 3000769 | 7/1980 | Fed. Rep. of Germany . | |
| 0012680 | 5/1978 | Japan | 252/632 |
| 0103998 | 8/1979 | Japan | 252/632 |
| 0103997 | 8/1979 | Japan | 252/632 |

OTHER PUBLICATIONS

Hawley, G., 1981, The Condensed Chemical Dictionary, Van Nostrand Reinhold Company, New York, p. 545.

*Primary Examiner*—Stephen J. Lechert, Jr.
*Assistant Examiner*—Howard J. Locker
*Attorney, Agent, or Firm*—Fay, Sharpe, Beall, Fagan, Minnich & McKee

[57] ABSTRACT

This invention relates to a method of processing radioactive waste, comprising the steps of converting organic radioactive waste into inorganic waste, pulverizing the inorganic waste, and solidifying the pulverized product with an inorganic hardening agent. According to the present invention, a solidified body having money-saving characteristics and a high volume reducing effect and capable of standing all kinds of weather condition excellently for a long period of time can be obtained.

17 Claims, 4 Drawing Figures

METHOD OF PROCESSING RADIOACTIVE WASTE

This application is a continuation of application Ser. No. 500,827, filed June 3, 1983, now abandoned.

BACKGROUND OF THE INVENTION

This invention relates to a method of processing radioactive waste, and more particularly to a method of processing radioactive waste, which has high money-saving and volume-reducing effect, and which permits radioactive waste to be formed into a solidified body having so high a durability with respect to the weather that allows the radioactivity in the solidified body to be sufficiently attenuated.

The waste occurring in a nuclear power plant includes mainly spent ion exchange resin, spent filtration assistant, regeneration waste liquid containing as its main component sodium sulfate ($Na_2SO_4$) spent for regenerating the spent ion exchange resin, and liquid waste containing boric acid as its main component. Among the above radioactive waste, the spent ion exchange resin (which will be hereinafter referred to as a waste resin) is stored, in a conventional nuclear power plant, in a tank provided therein. On the other hand, the regeneration waste liquids are solidified as they are, after they are dried and pulverized or after they are pelletized, with cement, asphalt or a plastic so as to be stored. In order to reduce the amount such waste, it is necessary that the volume of the waste to be stored and an amount of secondary waste generated during a waste-processing operation be minimized. It has been demanded that a final waste-processing method be developed in the future, which method permits forming radioactive waste into a solidified body, which does not vary in its form with the lapse of time and which is not influenced by environmental conditions, such as the weather for as long as several ten or several hundred years whether the solidified body is stored on land or whether it is thrown away into the sea.

SUMMARY OF THE INVENTION

An object of the present invention is to provide a method of processing radioactive waste, which has high money-saving and volume-reducing effect, and which permits radioactive waste to be formed into a safe solidified body having a high durability and capable of maintaining its required physical properties for so long a period of time to allow the radioactivity in the solidified body to become sufficiently attenuated.

The basic characteristics of the present invention, which has been developed with a view to achieving the above object, reside in that the radioactive waste occurring in a nuclear power plant is processed into a complete inorganic material by decomposing the waste in all of the steps of the method, i.e. the steps of primarily, pulverizing the resulting waste, and solidifying the pulverized mass in an inorganic container with an inorganic hardening agent, whereby the waste can be processed into an inorganic material without mixing any organic material with the waste or without treating the waste with any organic material.

The above and other objects as well as advantageous features of the invention will become clear from the following description of the preferred embodiments taken in conjunction with the accompanying drawings.

DESCRIPTION OF THE PREFERRED EMBODIMENTS

Figure 1:
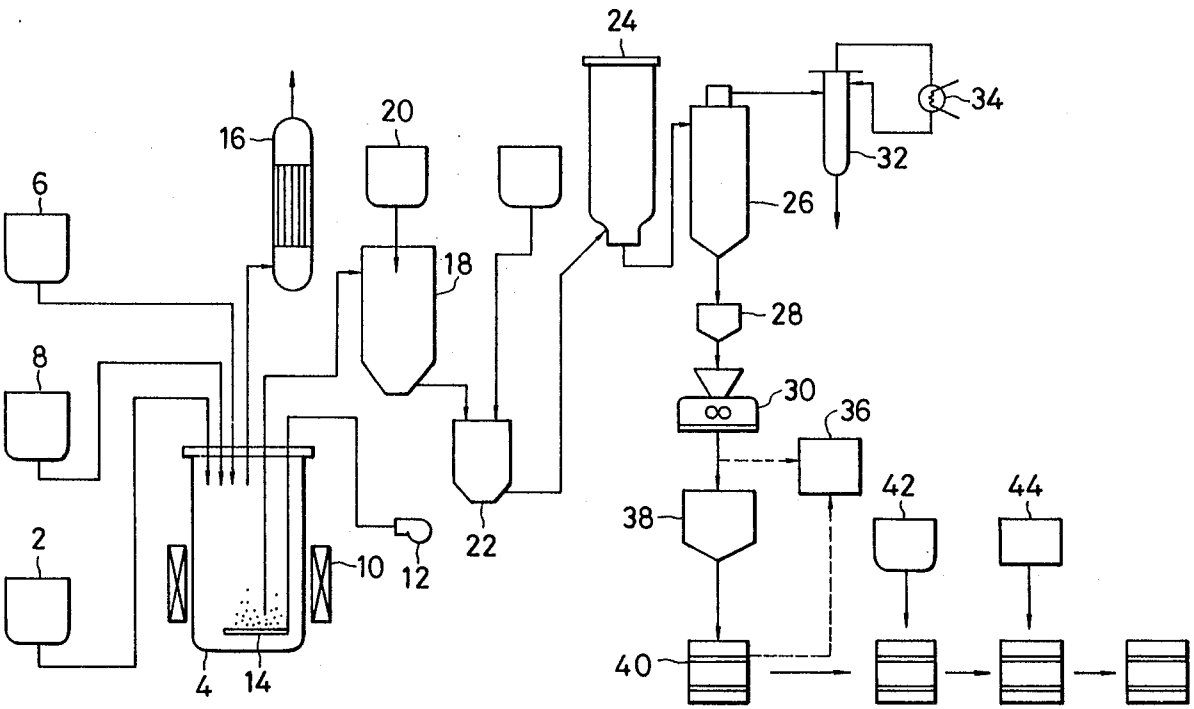
FIG. 1 is a system diagram showing an embodiment of a system as a whole for processing radioactive waste according to the present invention.

The basic concept of the present invention will now be described. The basic characteristics of the present invention reside in that the radioactive waste is processed to maintain the same in an inorganic state. The basic steps of the method include a step of making the radioactive waste inorganic, a step of condensing the waste thus rendered inorganic, which step constitutes the pre-treatment for the waste to be subsequently pulverized, a step of drying and pulverizing the condensed waste, a step of pelletizing the pulverized waste, and a step of adding an inorganic hardening agent to the pelletized waste to solidify the resulting product in an inorganic container.

Among the above steps, the pelletization step may be omitted if not necessary. Namely, the pulverized waste may be homogeneously solidified as it is with an inorganic hardening agent. When the dose of the waste is high, the waste may be either temporarily stored to attenuate the radioactivity thereof before it is subjected to a solidification step, or mixed with another waste having a low radioactive concentration without being subjected to the attenuation of the radioactivity thereof.

Among the radioactive waste, a regeneration waste liquid or a boric acid-containing waste liquid may be processed by separating such waste liquid from the solid matter, such as a waste resin, transferring the resulting waste liquid directly to a waste-condensing step without subjecting the same to a decomposing step, to be mixed with inorganic waste and condensed.

The treatment for the waste in a decomposing step is not specially limited; any treatment may be employed, which permits the volume of the waste to be reduced while putting it in an inorganic state. The flammable waste may be incinerated in the presence of oxygen. A waste resin may be incinerated just as the flammable waste, or subjected to oxidation decomposition. Suitable oxidation decomposition processes include a wet type oxidation process, in which the flammable waste is subjected to oxidation combustion with high-pressure oxygen or hydrogen peroxide in an aqueous phase of a high temperature and high pressure, and a process, in which the flammable waste is subjected to decomposition with an acid, such as concentrated sulfuric acid or nitric acid.

An embodiment of the present invention will now be described with reference to FIG. 1. While a nuclear power plant is operating an ion exchange resin and a filtration assistant are used to remove the clad (consisting mainly of iron oxide) and metal ion from the condensate in a condensate-purifying system. The spent ion exchange resin (waste resin) and spent filtration assistant (waste filtration assistant) necessarily occur as waste sludge. The waste sludge is stored temporarily in a waste sludge tank 2 provided in a nuclear power plant. A small amount of clad sticks to the waste sludge. In order to carry out a waste sludge-processing operation, it is necessary that the radioactive concentration of the waste sludge be reduced to not more than predetermined level. The waste sludge is transferred from the tank 2 to a decomposition vessel 4.

In addition to the waste sludge, liquid hydrogen peroxide ($H_2O_2$), compressed air and a ferric sulfate solution ($Fe_2(SO_4)_3$) are sent to the decomposition vessel 4. The liquid hydrogen peroxide is sent from an oxidizing agent tank 6 to the decomposition vessel 4, in which the waste sludge is subjected to oxidation decomposition. A ferric sulfate solution is sent from a catalyst tank 8 to the decomposition vessel 4 to serve as a catalyst for an oxidation decomposition reaction of the waste sludge with the hydrogen peroxide. In order to effectively carry out the oxidation decomposition reaction, the decomposition vessel 4 is preferably heated in such a manner that the temperature in the interior thereof can be maintained at 80°-100° C. A heater 10 is provided on an outer circumferential surface of the decomposition vessel 4 to regulate the temperature therein. The compressed air is introduced into the decomposition vessel 4 by a compressor 12 via an air diffuser 14 provided at a bottom portion of the vessel 4. The compressed air serves as a means for agitating the waste sludge in the decomposition vessel 4, and a means for regulating the temperature therein to a suitable level in the mentioned range by varying a flow rate of the compressed air. Namely, the compressed air serves to promote the oxidation decomposition of the waste sludge in cooperation of the catalyst.

In the decomposition vessel 4, OH radical occurs first in the liquid hydrogen peroxide due to the action of iron ion in the ferric sulfate in accordance with the following formulae.

$$Fe^{3+} + H_2O_2 \rightarrow Fe^{2+} + HO_2.H^*$$

$$Fe^{2+} + H_2O_2 \rightarrow Fe^{3+} + OH^- + OH^*$$

N.B. radical which is rich in reaction and activation.

The OH radical works on cross-linked portions of the resin to decompose the same into carbon (C), hydrogen (H), which are the elements constituting the main components of the cross-linked portions of the resin, water ($H_2O$) and carbon dioxide ($CO_2$). The OH radical also works on the hydrogen peroxide to generate oxygen ($O_2$) due to the following reactions.

$$OH^*. + H_2O_2 \rightarrow H_2O + OH^*.$$

$$HO^*. + Fe^{3+} \rightarrow H^+ + Fe^{2+} + O_2$$

$$HO_2^{2+}. + Fe^{2+} \rightarrow HO_2^- + Fe^{3+}$$

An optimum concentration of iron ion to be added as a catalyst to a waste anion exchange resin is around 0.02–0.06mol/liter, and an optimum concentration of iron ion to be added as a catalyst to a waste cation exchange resin is in a range wider than the range mentioned above. When the waste sludge is thus subjected to the oxidation decomposition, a reaction gas consisting mainly of carbon dioxide is generated at a low rate as the decomposition progresses. The reaction gas and spent air are cooled in a cooler 16 to be then discharged therefrom into a gas-processing system (not shown). In the meantime, sulfur ion ($SO_4^{2-}$) of an ion exchange radical of the decomposed waste resin is left in the resulting decomposed liquid.

The decomposed liquid in the decomposition vessel 4 contains sulfur ion as mentioned above, and it is, therefore, acid. If the decomposed liquid is sent as it is to a subsequent step, tanks, pipes, and a drier, which will be described later, would be corroded. In order to prevent the corrosion of these parts, the decomposed liquid is sent to a neutralization vessel 18, in which the decomposed liquid is neutralized with a solution containing about 20% sodium hydroxide. A solution of sodium hydroxide is used as a liquid for regenerating an ion exchange resin in a power plant. A part of the solution of sodium hydroxide can be introduced from a neutralization liquid tank 20 into the neutralization vessel 18. In the neutralization vessel 18, sodium sulfate ($Na_2SO_4$) is generated due to a neutralization reaction reaction between the hydroxyl ion ($OH^-$) in the sodium hydroxide and the sulfur ion ($SO_4^{2-}$), and ion exchange radical in the waste resin. The sodium sulfate is a substance identical with a main component of a liquid, which has been used in the power plant to regenerate the ion exchange resin. Accordingly, the sodium sulfate can be conveniently mixed with a liquid, which has been used to regenerate the ion exchange resin, to be processed in a concentration step and a drying and pulverization step, which will be described later. In the case where about 5.0% by weight of a slurry of a waste resin is decomposed to be then neutralized in the neutralization vessel 18, the concentration of sodium sulfate in the resulting decomposed liquid becomes about 1.8 weight percent.

The decomposed liquid containing as its main component sodium sulfate generated in the neutralization vessel 18 and a regeneration waste liquid containing sodium sulfate, which occurs during the regeneration referred to above of the ion exchange resin, are mixed, and the clad contained in these two liquids is separated in a clad separator 22. The mixed liquid, from which the clad has been removed, is sent to a concentrator 24, in which the liquid is thermally concentrated until the concentration of a solid portion thereof has reached about 18 weight percent.

In a pressurized water reactor type power plant, a boric acid waste liquid occurs as a radioactive waste liquid. Such a waste liquid is mixed with a decomposed liquid obtained after the completion of the decomposition of a resin, and the resulting mixture is neutralized with sodium hydroxide (NaOH) in the neutralization vessel 18. The neutralized product is then thermally condensed in the concentrator 24 until the concentration of a solid portion thereof has reached about 18 weight percent.

The same method can be applied to a waste resin and a waste liquid (sodium nitrate=$NaNO_3$) occurring in a regeneration process. In this case, a waste resin is decomposed, and the decomposed liquid is neutralized. The neutralized product is sent with a liquid of sodium sulfate to the concentrator 24, in which the mixed liquid is condensed until the concentration of a solid portion thereof has reached about 18 weight percent.

The waste liquid condensed in the concentrator 24 is sent to a centrifugal film dryer 26 to be dried and pulverized. The water content of the resulting pulverized waste is determined by a neutron water guage 28 provided on the downstream side of the centrifugal film drier 26. The portion of the pulverized waste which has a water content of not less than a predetermined level is dissolved in hot water and returned to the centrifugal film drier 26 to be processed again. The portion of the pulverized waste which has a water content of not more than a predetermined level is sent to a granulator 30.

In the meantime, the vapor occurring in the centrifugal film drier 26 is decontaminated in a mist separator 32 and then condensed in a condenser 34. The resulting condensate is used as decontaminating water in the mist separator 32 to be then returned to a concentrator to be concentrated.

The pulverized waste having a water content of not more than a predetermined level is molded into almond-shaped pellets by a briquetting granulator 30.

The pelletized waste can be packed in a storage tank or container to be stored 36 for a predetermined period of time for the purpose of attenuating the radioactivity thereof. In order to keep the pelletized waste in a storage tank, it is necessary that the relative humidity therein be set to a low level so as to maintain the soundness of the pellets in store. In order to meet the requirements, the moisture in the air in the storage tank is removed by a demoisturing device as the air is circulated by a blower. It is desirable that a particle filter be provided at an outer edge of the storage tank with the interior thereof kept at a low vacuum so as to prevent the pulverized waste from scattering to the outside of the storage tank. When the pelletized waste is packed in a container to be stored, the container is sealed, so that the pelletized waste can be kept without regulating the humidity in the container and irrespective of the condition of the outside air.

The pelletized waste can be stored temporarily as mentioned above, or, when it does not require temporary storage, the pelletized waste can then be packed in a container 40 to be formed into a solidified body. A container 40 to be used for discarding the solidified waste into the deep seawater must be capable of preventing the discarded solidified body from being destroyed, and the radioactive substances from flowing out therefrom for a long period of time. A container 40 to be used for discarding the solidified waste on land must be capable of being not corroded for not less than several tens of years. Namely, the container 40 must be capable of preventing the radioactive waste from flowing out therefrom, and must have such high sealability and corrosion resistance to permit the radioactive waste to be safely kept on the ground, in the sea and under the surface of the ground without diffusing the radioactive substances even when the container 40 drops or catches fire. A waste-solidifying container having the above-mentioned properties and used in the invention consists of polymer-impregnated concrete. The polymer-impregnated concrete is a compound material made by filling the cavities in the cement concrete with a polymerizable monomer, and subjecting the monomer to polymerization to unite the same with the concrete. The concrete has high strength, water-impermeability, chemical resistance and durability, and is suitably used to make containers for solidified radioactive waste.

A method of packing waste, which has been pelletized by the granulator 30, in a container 40 to form a solidified body will now be described. The pelletized waste is sent from the granulator 30 to a pellet-measuring hopper 38, in which an amount of pellets to be packed in the container 40 is measured to place an optimum amount of pellets in the container 40. Sodium silicate is then injected as a hardening agent from a tank 42 into spaces among the pellets in the container 40. The resulting container 40 is capped with a cover, which has post-filling openings, with an inorganic bonding agent, and cured for a predetermined period of time under the predetermined environmental conditions. After the container 40 has been cured for a predetermined period of time, it is transferred to a post-filling area, in which the post-filling of an empty space above the solidified body and in the container 40 is carried out by a post-filling unit 44 through 2–5 openings (one of which is an air discharge port) in the cover referred to above. The solidified body thus comes to have no hollow portions therein. Finally, the openings are closed with plugs to seal the container 40. In a container 40 with a solidified body to be discarded into the seawater, the presence of hollow portions therein adversely affect the security of the strength thereof. In case of a container 40 with a solidified body to be disposed on the ground by merely piling it on another to be stored, the post-filling may not necessarily be carried out. The pelletized waste packing method described above can also be applied to the case where the waste in a pulverized state is kneaded with a hardening agent to be homogeneously solidified.

Figure 2:
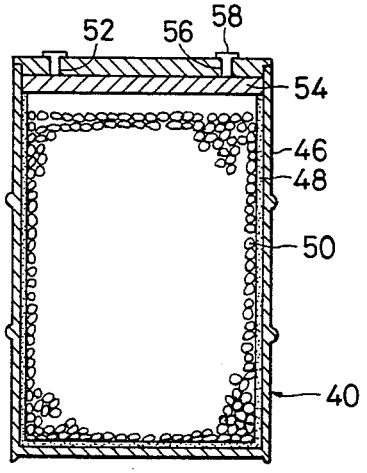
FIG. 2 is a sectional view of a solidified body formed by the processing method according to the present invention, and a container therefor.

FIG. 2 shows a waste-solidifying container 40, which consists of a 200-liter drum can 46, and a thin-walled polymer-impregnated concrete vessel 48 formed on an inner surface of the drum can 48, and which contains therein a solidified body formed by injecting pelletized radioactive waste 50 and a hardening agent into the container 40 to solidify the waste, extracting an internal gas from an air discharge port 52 to form a post-filling 54, and thereafter sealing an injection port 56 and air discharge port 52 with plugs 58. The solidified body of waste thus sealed in the container 40 is subjected to a final disposing method. Namely, it is kept on the ground or thrown away into the deep seawater.

In this embodiment, sodium silicate is used as a hardening agent. The same effect can also be obtained when a silicic acid alkali compound, such as potassium silicate and calcium silicate, or an inorganic material, such as cement is used for the same purpose.

In this embodiment, iron ion is added as a catalyst to the waste sludge in a sludge decomposing process, in which the waste sludge is subjected to oxidation decomposition using hydrogen peroxide. The same effect can also be obtained sufficiently when chromic acid ion, such as potassium chromate is used. The oxidation decomposition process carried out with hydrogen peroxide in the presence of chromic acid ion is effective, especially, for decomposing an anion exchange resin. It is said that an anion exchange resin in general is not easily oxidation-decomposed. However, it has been discovered that an anion exchange resin can be decomposed even at normal temperature in the presence of chromic acid ion.

Figure 3:
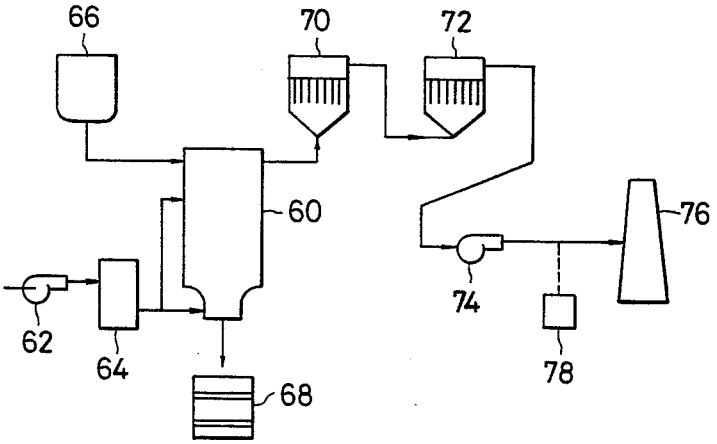
FIG. 3 is a system diagram showing another embodiment of the present invention utilizing a combustor.

In this embodiment, the waste sludge is disorganized by utilizing an oxidation-decomposition reaction with hydrogen peroxide. The waste sludge may be subjected to combustion to be decomposed. Another embodiment, in which the waste sludge is subjected to combustion to be decomposed, will be described with reference to FIG. 3. Referring to FIG. 3, a combustor 60 has a fluidized bed at its bottom portion, and is heated with a suitable means, for example, the combustion heat of afuel or waste, or the heat of steam or the electric heat. First, the air is sent by a blower 62 to a preheater 64 to be preheated, and the resulting air to the combustor 60 to be heated to 1000°–1200° C. with the above-mentioned heating means. In the meantime, the waste sludge is supplied from a tank 66 into the combustor 60 via an upper portion thereof to be burnt with the high-temperature air having a temperature in the above-mentioned range. The solid matter (ash) left over after the combustion of the waste sludge has been completed is taken from a lower portion of the combustor 60 into a container 68 to be packed therein. The solid matter packed in the container 68 is hardened with inorganic hardening agent in a container to form a solidified body. A waste gas occurring in the combustor 60 is subjected to the removal of solid matter with a coarse filter 70 at 800°-900° C. The resulting waste gas is further subjected to the removal of solid matter with a high-efficiency filter 72 at about 600° C. in the same manner as mentioned above. The waste gas, from which the solid matter has been removed, is transferred under pressure by a blower 74 to a stack 76. In the middle of a passage, through which the waste gas with the solid matter removed therefrom is transferred to the stack 76, the radioactive concentration of the waste gas is measured with a radiation monitor 78. The portion of the waste gas which has finished being monitored with respect to its radioactive concentration is discharged from the stack 76 to the atmospheric air. This embodiment employs an opened loop cycle, in which the waste gas is discharged to the atmospheric air. In the case where waste gas cannot be released, a closed loop cycle can be substituted for the opened loop cycle to return the waste gas to the fluidized bed in the combustor 60 and use the same for the fluidization of the material in the combustor.

Figure 4:
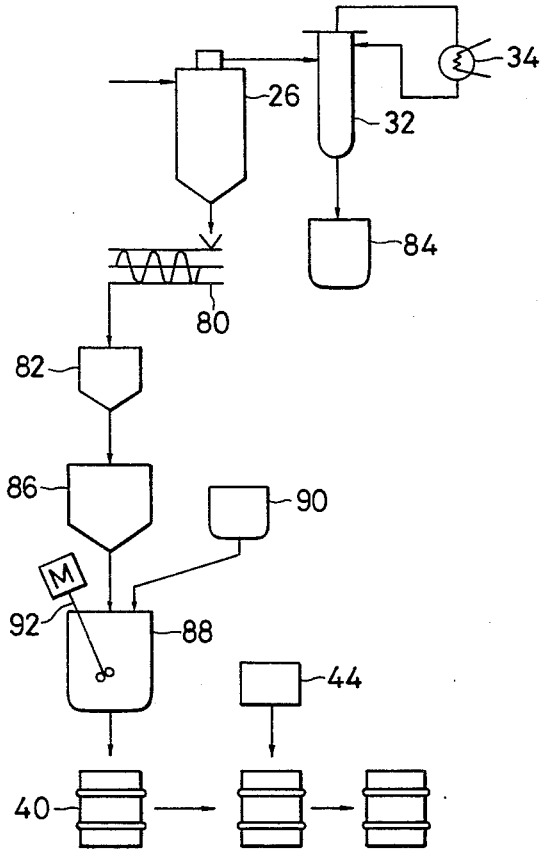
FIG. 4 is a system diagram showing still another embodiment of the present invention, in which the radioactive waste is homogeneously solidified.

In the embodiment shown in FIG. 1, the waste is dried and pulverized, and the pulverized waste is formed into pellets, which are then solidified. The pulverized waste can be homogeneously solidified as it is with a hardening agent. Still another embodiment, in which the pulverized waste is homogeneously solidified, will be described with reference to FIG. 4. Regarding the embodiment shown in FIG. 4, only a drying-pulverization step and the later steps will be described. The other steps are identical with the corresponding steps in the embodiment shown in FIG. 1, and the description of these steps will be omitted. A decomposed liquid of waste sludge sent to the centrifugal film drier 26 is pulverized therein, and the pulverized body is transferred to a storage vessel 82 therefor by a screw feeder 80. In the meantime, the vapor occurring in the drier 26 is sent to a mist separator 32 to be subjected to gas-liquid separation. The separated vapor is made dense in a condenser 34, and the condensed product is returned to the mist separator 32 again. The condensed product thus returned to the mist separator 32 and a liquid separated therein are stored in a solution tank 84. The liquid in the tank 84 is reused in the nuclear power plant. The pulverized waste in the vessel 82 is sent to a pulverized body measuring hopper 86, and an optimum amount of pulverized waste is introduced from the hopper 86 into a mixing vessel 88. In the mixing vessel 88, the pulverized waste and a hardening agent consisting of a silicic acid alkali liquid sent from a hardening agent tank 90 are mixed with each other as they are stirred with an agitator 92. The resulting homogeneously-mixed product is placed from the mixing vessel 88 into a solidification container 40, and a post-filling operation is carried out by a post-filling unit 44. Finally, the container 40 is sealed to form a final solidified body.

According to the present invention, the waste sludge consisting of a waste resin or a waste filtration assistant, which occur in a nuclear power plant, is processed independently or with a waste liquid occurring in the nuclear power plant as the sludge is kept in an inorganic state in all of the steps of the process. Therefore, the present invention can provide a method of processing radioactive waste, which permits forming the waste into a solidified body, which is not influenced for a long period of time by environmental conditions on the ground and in the seawater, and which has high durability and volume-reducing effect. The following are the detailed effects of the present invention.

(1) In a step to convert organic waste into inorganic waste, in which the waste sludge is oxidation-decomposed with liquid hydrogen peroxide in the presence of a catalyst, 95-98% by weight of a waste resin and a waste filtration assistant can be decomposed. Moreover, substantially no secondary waste, which causes troubles in a radioactive waste processing operation, occurs, so that a volume reducing ratio in the waste processing system as a whole becomes extremely high. For example, Table 1 shows the waste resin processing effect of the present invention, i.e. the volume of a waste resin, which is measured before the waste resin is processed, in contrast to the volume of the waste resin, which is measured after the waste resin is processed. Referring to Table 1, when a hydrogen peroxide liquid and a sodium hydroxide liquid are added to 5l unprocessed slurry of a waste resin to decompose the latter, 5.7l decomposed liquid is obtained. Since the waste resin is oxidation-decomposed, the concentration of solids in the slurry decreases from 4.0 weight percent of resin to 1.8 weight percent of sodium sulfate. This is a weight reduction of 1.8/4.0 or about 1/2.2. When the same amount of an unprocessed waste resin is formed as it is into pellets having a specific gravity of 1.21, the volume of the pellets becomes 0.17l. When the same waste resin is formed into pellets after it has been oxidation-decomposed, the volume of the pellets becomes 0.043l. Consequently, a final volume reduction ratio of 0.043/0.17=1/3.9 can be obtained.

TABLE 1

Comparison between the volume of unprocessed waste resin and that of oxidation-decomposed waste resin.

| | Unprocessed waste resin | Processed waste resin |
|---|---|---|
| Amount of slurry | 5.0 l | 5.7 l |
| Concentration of slurry | 4.0 wt. % | 1.8 wt. % |
| Amount of pellets | 0.17 l | 0.043 l |
| Final volume reduction ratio | 3.9 | 1 |

The results of a similar experiment on a waste filtration assistant are shown in Table 2. According to Table 2, the concentration of unprocessed waste filtration assistant in the slurry is 5.0 weight percent while that of the waste filtration assistant processed according to the oxidation decomposition process is 0.05 weight percent. This is a weight reduction of 0.05/5.0 or 1/100. A volume reduction ratio of 1/173 can be obtained.

TABLE 2

Comparison between the volume of unprocessed waste filtration assistant and that of waste filtration assistant oxidation-decomposed with liquid hydrogen preoxide.

| | Unprocessed waste filtration assistant | Processed waste filtration assistant |
|---|---|---|
| Amount of slurry | 5.0 l | 5.6 l |
| Concentration of slurry | 5.0 wt. % | 0.05 wt. % |
| Amount of pellets | 0.207 l | 0.0012 l |

TABLE 2-continued

Comparison between the volume of unprocessed waste filtration assistant and that of waste filtration assistant oxidation-decomposed with liquid hydrogen preoxide.

| | Unprocessed waste filtration assistant | Processed waste filtration assistant |
|---|---|---|
| Final volume reduction ratio | 173 | 1 |

(2) The waste sludge can be decomposed inorganically by oxidation-decomposing the same with liquid hydrogen peroxide at a low temperature of 80°–100° C. and at an atmospheric pressure. Accordingly, the processing apparatus need not be provided with any heat and pressure resisting means. This allows the processing system as a whole to be constructed simply and economically.

(3) Since a wate resin is decomposed by oxidation-decomposing or burning the same, and then pulverized by a centrifugal film drier, the following effects can be obtained.

(a) A waste resin normally has a specific gravity of 1.1–1.5, and is heavier than water. Therefore, a waste resin sinks to a bottom portion of a tank. In order to transfer a waste resin in an unprocessed state through a pipe, it is necessary that the concentration of the resin be set to 5–10 weight percent to prevent the pipe from being blocked up therewith. Accordingly, a large amount of transfer water is required, and the processing efficiency of a centrifugal film drier decreases. On the other hand, when a waste resin decomposed and then dried and pulverized is transferred through a pipe, an amount of transfer water can be minimized, and the concentration of the waste to be sent to a drier can be increased to about 20 weight percent. This allows the efficiency of drying and pulverizing a waste resin to be improved.

(b) When a waste resin is dried and pulverized as it is, the resin powder is likely to explode since the particles thereof are flammable. In order to prevent the pulverized waste resin from exploding, it is necessary that a countermeasure be taken; for example, a nitrogen gas purge. A preferable method of eliminating the possibility of explosion of waste resin in a drier is to decompose it into sodium sulfate.

(c) When a waste resin is pulverized as it is, fine particles having a plurality of projections and recesses on and in the outer surfaces thereof are obtained; such a waste resin cannot be pulverized perfectly with ease. Moreover, the water deposited on and in the projections and recesses cannot be gasified easily. After all, the water content of the waste resin is reduced to only about 5 weight percent. It is difficult form fine particles of waste resin having a high water content into pellets. Pellets having a high water content have a low weather resistance, a low water permeation resistance and a low strength. On the other hand, inorganic waste resin consists mainly of sodium sulfate, and, therefore, the water content thereof can be reduced to as low as 1 weight percent. Accordingly, a inorganic waste resin can be formed into pellets having excellent properties as mentioned above.

(d) When a waste resin is dried and pulverized as it is, the resin component thereof is thermally decomposed to generate ammonia ($NH_3$). Therefore, it is necessary that an ammonia removing means be provided on the side of a drier which is closer to a condenser. On the other hand, when a inorganic waste resin is dried and pulverized, ammonia is not generated. In this case, no special countermeasure against gases is required, and the purity of condensate can be increased.

(4) When a waste resin decomposed and pulverized is formed into pellets, the following effects can be obtained.

(a) In order that pellets are not destroyed while they are handled, it is necessary that each pellet withstand a load of about 1 kg. Consequently, in order to pulverize an unprocessed waste resin and then form the pulverized body into pellets, it is necessary that 10–20% by weight of binder, which consists of epoxy resin or cellulose, be added to the waste resin. On the other hand, when a decomposed waste resin, which consists mainly of sodium sulfate, is used, pellets having a sufficiently high strength can be obtained without using any binder. Since no binder is required, a means for mixing a binder with a pulverized waste resin can be omitted. This allows the construction of the waste processing system to be simplified, the volume reduction ratio to be improved by 7–15%, water soluble pellets to be obtained, and the granulator to be decontaminated with water.

(b) In pellets, which are obtained by pressure-molding a pulverized waste resin, a spring-back phenomenon occurs since the resin is an elastic material. In order to prevent this phenomenon, it is necessary that a granulator be operated with the pressure rolls therein driven at a reduced number of revolutions per minute. On the other hand, when inorganic waste resin, which has no elasticity, is pelletized, a granulator can be operated with the pressure rolls therein driven at a larger number of revolutions per minutes. This allows a pelletization rate to be improved.

What is claimed is:

1. A method of processing radioactive organic waste occurring in a nuclear power plant for storage, comprising:

reducing the volume of said radioactive organic waste, wherein said radioactive organic waste includes at least one of a spent ion exchange resin and spent filter assistant by converting said radioactive organic waste to inorganic waste by way of an oxidation decomposition process with liquid hydrogen peroxide, said at least one of said spent ion exchange resin and said spent filter assistant being decomposed into water and carbon dioxide by way of the oxidation decomposition process with said hydrogen peroxide liquid to leave a residue of inorganic waste;

neutralizing the residue of the inorganic waste with an alkali substance;

pulverizing the residue of the inorganic waste; and packing the pulverized inorganic waste in a container with an inorganic hardening agent to solidify the resulting mixtures therein.

2. A process according to claim 1, wherein 95 to 98% by weight percent of the at least one of spent ion exchange resin and spent filter assistant organic waste is converted to inorganic waste.

3. A process according to claim 1, wherein after pulverizing and before packing, the inorganic waste is formed into pellets.

4. A process according to claim 3 wherein the radioactive organic waste is spent ion exchange resin and the pellets can withstand a load of 1 kg.

5. A process according to claim 3 wherein the volume reduction ratio is in the range of about 1/3.9 to 1/173.

6. A process according to claim 3 wherein the weight reduction ratio is in the range of 1/2.2 to 1/100.

7. A method of processing radioactive organic waste in a slurry occurring in a nuclear power plant for storage, comprising:

reducing the volume of said radioactive organic waste, wherein said radioactive organic waste includes at least one of a spent ion exchange resin and spent filter assistant by converting said radioactive organic waste to inorganic waste by way of an oxidation decomposition process with hydrogen peroxide liquid in the presence of one of ferric ions and chromate ions, so that said at least one of said spent ion exchange resin and said spent filter assistant is decomposed into water and carbon dioxide by way of the oxidation decomposition process with the hydrogen peroxide liquid to leave a residue of inorganic waste;

neutralizing the residue of inorganic waste with an alkali substance;

heating the neutralized residue of inorganic waste to concentrate the same;

pulverizing the neutralized and concentrated residue of inorganic waste; and pelletizing the pulverized residue of inorganic waste.

8. A method according to claim 7, wherein the oxidation-decomposition occurs in the presence of a catalyst selected from the group consisting of ferric sulfate and potassium chromate.

9. A process according to claim 7, wherein the hardening agent is selected from the group consisting of sodium silicate, potassium silicate, calcium silicate and cement.

10. The process according to claim 7, wherein oxidation occurs at a temperature of 80°–100° C. as well as in the presence of compressed air, said compressed air being supplied constantly.

11. The process according to claim 10, wherein the OH radical is produced which works on cross-linked portions of the resin to convert the same into carbon, hydrogen, water and carbon dioxide.

12. The process according to claim 7, wherein the concentration of ferric ion is in the range of 0.02–0.06 mol/liter for waste and ion exchange resin, and in a greater range for waste cation exchange resin.

13. The process according to claim 7, wherein the neutralized waste is concentrated to 18 weight percent solids prior to pulverizing.

14. A process according to claim 7, wherein the ion exchange resin is anion exchange resin and the catalyst is potassium chromate.

15. A process according to claim 7, wherein the radioactive organic waste is spent ion exchange resin and the pellets can withstand a load of 1 kg.

16. A process according to claim 7, wherein the heated, neutralized waste is pulverized in a centrifugal film drier.

17. A process according to claim 7 wherein the alkali substance is a 20% solution of sodium hydroxide.

* * * * *